US009176452B2

(12) United States Patent
Ito

(10) Patent No.: US 9,176,452 B2
(45) Date of Patent: Nov. 3, 2015

(54) IMAGE FORMING APPARATUS

(71) Applicant: KYOCERA Document Solutions Inc., Osaka (JP)

(72) Inventor: Shigeharu Ito, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/661,681

(22) Filed: Mar. 18, 2015

(65) Prior Publication Data

US 2015/0277326 A1 Oct. 1, 2015

(30) Foreign Application Priority Data

Mar. 26, 2014 (JP) ..... 2014-064852

(51) Int. Cl.
*G03G 15/08* (2006.01)
*G03G 15/00* (2006.01)

(52) U.S. Cl.
CPC ..... *G03G 15/556* (2013.01)

(58) Field of Classification Search
CPC ..... G03G 15/556
USPC ..... 399/27
See application file for complete search history.

(56) References Cited

U.S. PATENT DOCUMENTS

2012/0008969 A1* 1/2012 Mitamura ..... G03G 15/0891 399/53

FOREIGN PATENT DOCUMENTS

JP 2005-173088 A 6/2005

* cited by examiner

*Primary Examiner* — David Bolduc
*Assistant Examiner* — Barnabas Fekete
(74) *Attorney, Agent, or Firm* — Stein IP, LLC

(57) ABSTRACT

An image forming apparatus has an image carrier, a developing unit, a toner container, a pixel counter, and a used toner amount estimator. An electrostatic latent image is formed on the image carrier's surface. The developing unit feeds toner on the image carrier's surface. The toner container with a transport screw supplies toner to the developing unit. The pixel counter counts the number of pixels in toner images formed on the image carrier's surface since the toner container started being used. The used toner amount estimator estimates the amount of toner used, until the cumulative value of the number of revolutions of the transport screw reaches a predetermined number, based on the cumulative value and, thereafter, by multiplying the pixel count of the pixel counter by a coefficient. The estimator corrects the coefficient based on the pixel count as observed when the cumulative value reaches the predetermined number.

3 Claims, 7 Drawing Sheets

IMAGE FORMING APPARATUS

INCORPORATION BY REFERENCE

This application is based upon and claims the benefit of priority from the corresponding Japanese Patent Application No. 2014-064852 filed on Mar. 26, 2014, the entire contents of which are incorporated herein by reference.

BACKGROUND OF THE INVENTION

The present disclosure relates to an image forming apparatus, and more particularly to a technology for estimating the amount of toner remaining in a toner container.

In an electrophotographic image forming apparatus, image development is achieved by feeding toner from a developing unit to an electrostatic latent image formed on the surface of a photosensitive drum or an intermediary transfer belt. The toner is contained in a toner container, and as the toner concentration in the developing unit lowers, the toner container is driven by a toner motor so that the toner inside the toner container is, while being stirred by a stirring paddle, supplied to the developing unit by a transport screw. Thus, the amount of drive of the toner container determines the amount of toner supplied to the developing unit.

In recognizing when to replace a toner container, it is essential to estimate the amount of toner remaining in the toner container. The amount of toner transported as a result of a transport screw being driven to rotate is constant. This makes it possible to estimate the amount of toner remaining in the toner container by estimating the amount of toner used based on the cumulative value of the number of revolutions of the transport screw. However, as the amount of toner in the toner container becomes small, the amount of toner transported with every single turn of the transport screw comes to vary. Thus, estimating the amount of toner used based on the cumulative value of the number of revolutions of the transport screw may lead to a large error. As a solution, for example, the amount of toner used is often calculated based on, for a period from the start of use of the toner container to a given time point, the length of time for which toner has been supplied and, thereafter, the number of pixels in toner images.

SUMMARY OF THE INVENTION

According to one aspect of the present disclosure, an image forming apparatus includes an image carrier, a developing unit, a toner container, a pixel counter, and a used toner amount estimator. An electrostatic latent image is formed on a surface of the image carrier. The developing unit feeds toner to the electrostatic latent image to form a toner image on the surface of the image carrier. The toner container has a transport screw, and drives the transport screw to rotate to transport toner contained in the toner container to supply the toner to the developing unit. The pixel counter counts a number of pixels in toner images that have been formed on the surface of the image carrier since the start of use of the toner container. The used toner amount estimator estimates the amount of toner used, until the cumulative value of the number of revolutions of the transport screw reaches a predetermined number, based on the cumulative value of the number of revolutions of the transport screw and, thereafter, by multiplying the pixel count value of the pixel counter by a coefficient. Moreover, the used toner amount estimator corrects the coefficient based on the pixel count value of the pixel counter as observed when the cumulative value of the number of revolutions of the transport screw reaches the predetermined number.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
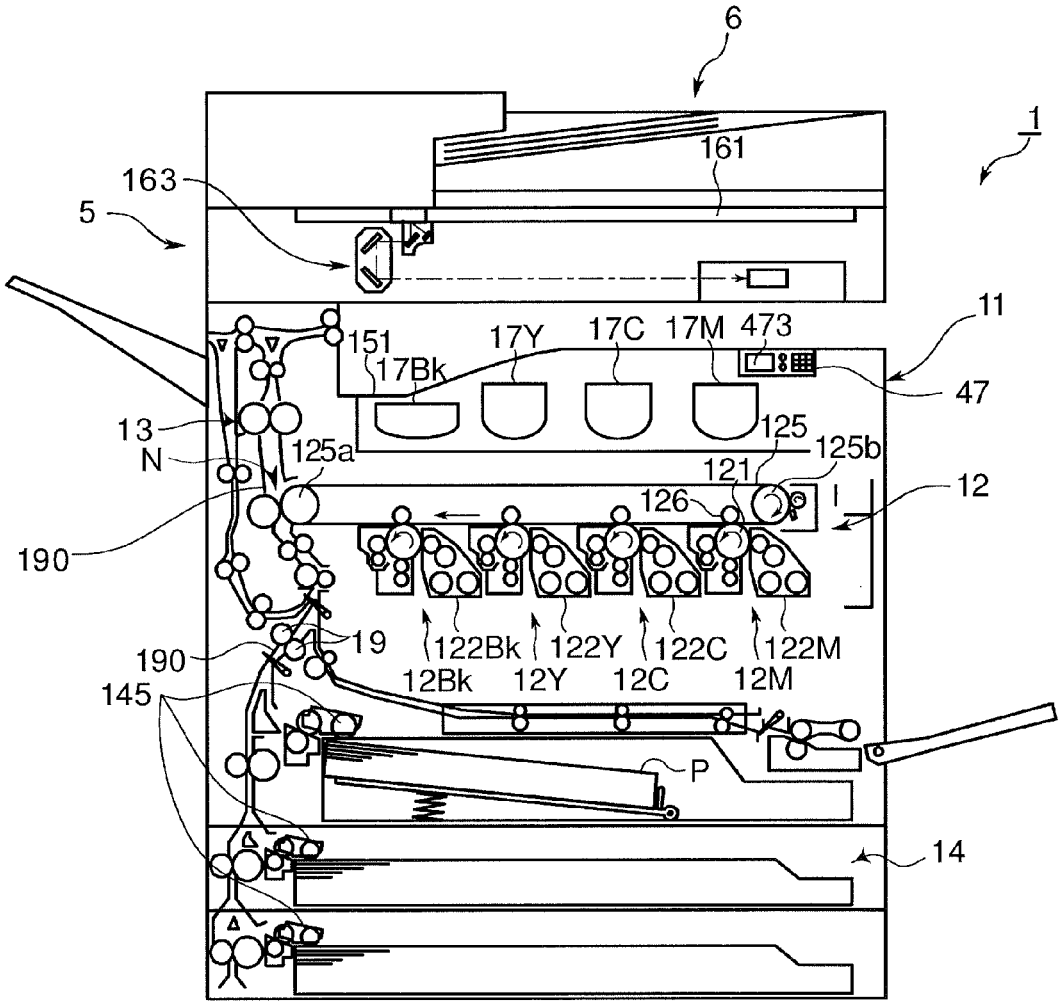
FIG. 1 is a front sectional view showing a construction of an image forming apparatus embodying the present disclosure.

Hereinafter, an image forming apparatus according to an embodiment of the present disclosure will be described with reference to the accompanying drawings. FIG. 1 is a front sectional view showing the construction of an image forming apparatus according to an embodiment of the present disclosure.

The image forming apparatus 1 according to an embodiment of the present disclosure is, for example, a multifunction peripheral provided with a plurality of functions such as a copy function, a printer function, a scanner function, and a facsimile function. The image forming apparatus 1 is provided with, inside an apparatus body 11, an operation section 47, an image formation section 12, a fusing section 13, a paper feed section 14, a document feed section 6, a document reading section 5, etc.

The operation section 47 accepts instructions, such as an image formation operation execution instruction and a document reading operation execution instruction, from an operator with respect to various operations and processes that the image forming apparatus 1 can execute. The operation section 47 is provided with a display section 473.

When the image forming apparatus 1 performs a document reading operation, the document reading section 5 optically reads the image of a document fed in by the document feed section 6, or the image of a document placed on a document placement glass 161, to generate image data. The image data generated by the document reading section 5 is stored in an internal HDD or in a computer or the like connected across a network.

When the image forming apparatus 1 performs an image formation operation, the image formation section 12 forms a toner image on recording paper P as a recording medium fed from the paper feed section 14 based on image data generated through the document reading operation mentioned above, or image data received from a computer connected across a network, or image data stored in the internal HDD, or other image data. When color printing is performed, an image forming unit 12M for magenta, an image forming unit 12C for cyan, an image forming unit 12Y for yellow, and an image forming unit 12Bk for black provided in the image formation section 12 respectively form toner images on photosensitive drums 121 according to images of the corresponding color components constituting the above-mentioned image data, through processes of electrostatic charging, exposure to light, and image development, and these toner images are then transferred to an intermediary transfer belt 125 by primary transfer rollers 126.

The toner images of the different colors thus transferred to the intermediary transfer belt 125 are, with adjusted transfer timing, superimposed on one another on the intermediary transfer belt 125 to form a color toner image. By a secondary transfer roller, the color toner image formed on the surface of the intermediary transfer belt 125 is, at a nip N between the secondary transfer roller and a driving roller 125*a* across the intermediary transfer belt 125, transferred to recording paper P that has been transported from the paper feed section 14 through a transport passage 190. Thereafter, the fusing section 13 fuses the toner image on the recording paper P to the recording paper P under heat and pressure. The recording paper P having gone through fusion and thus having the color image formed on it is discharged onto a discharge tray 151.

A developing unit (development section) 122M in the image forming unit 12M, a developing unit (development section) 122C in the image forming unit 12C, a developing unit (development section) 122Y in the image forming unit 12Y, and a developing unit (development section) 122Bk in the image forming unit 12Bk respectively perform image development for the corresponding colors.

Figure 2:
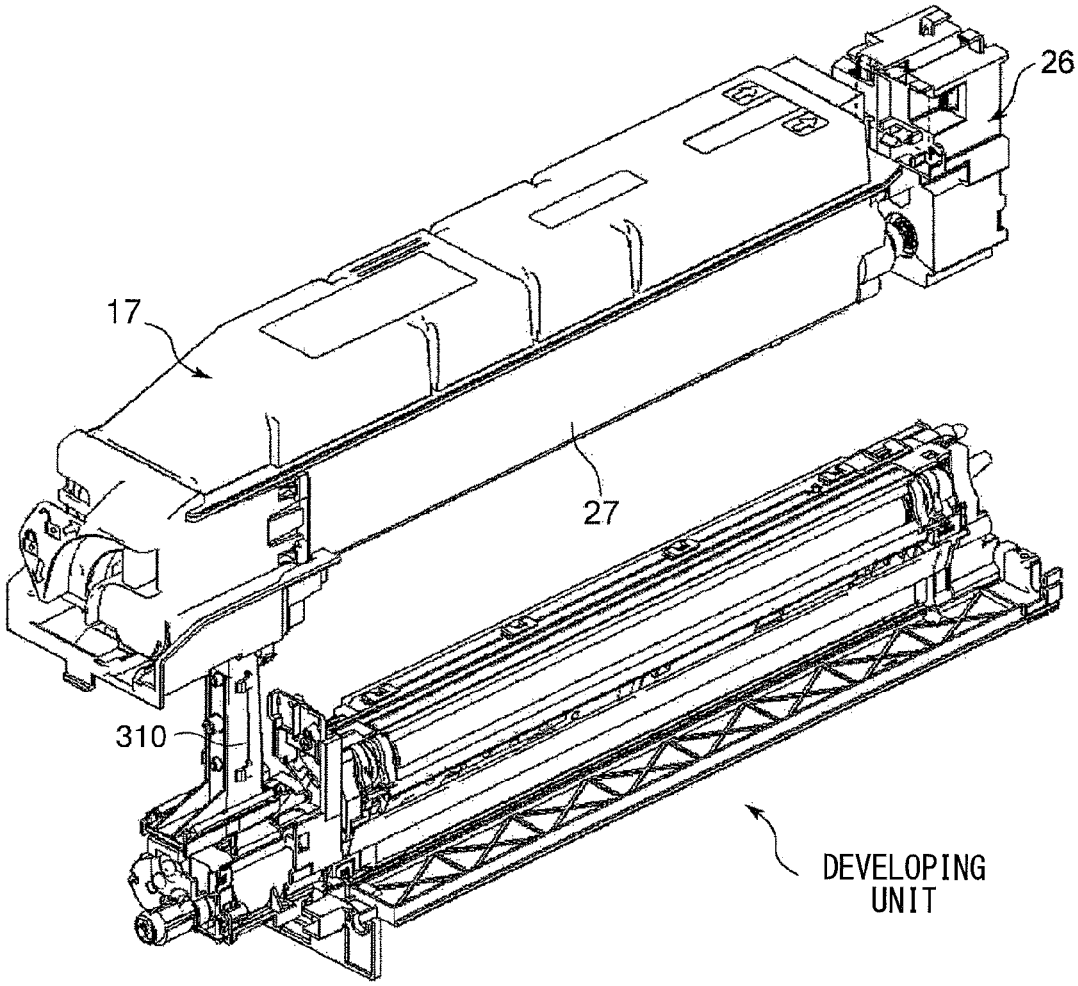
FIG. 2 is a perspective view showing connection between a toner container and a developing unit.
Figure 3:
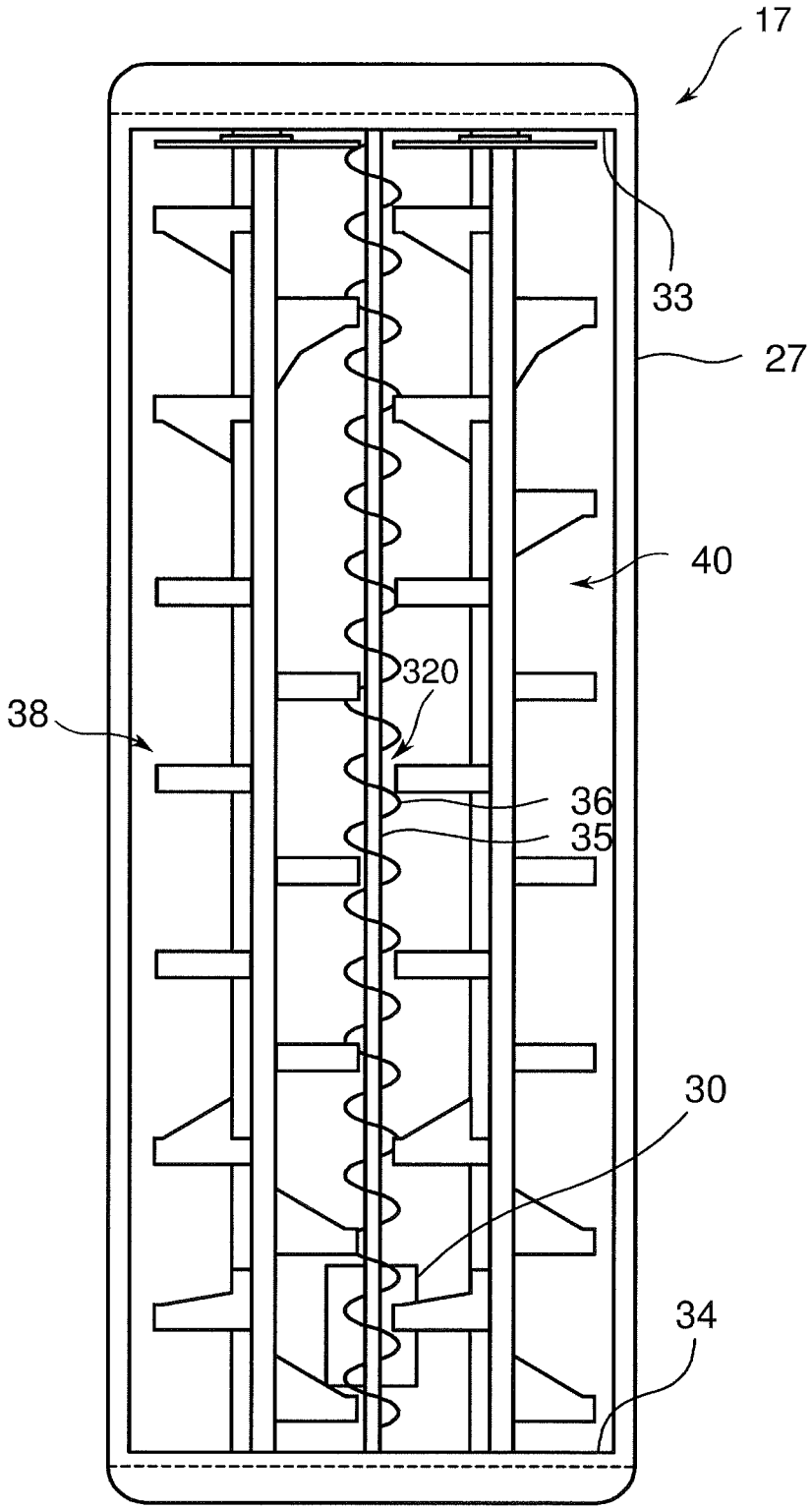
FIG. 3 is a plan view of a toner container with a cover removed.
Figure 4:
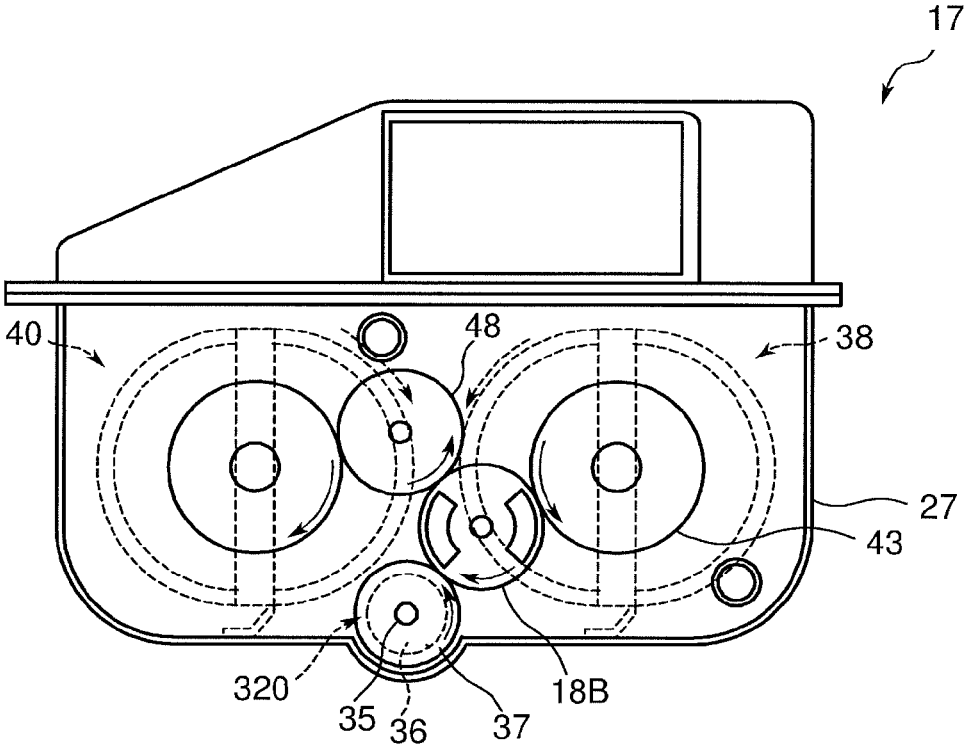
FIG. 4 is a rear view of a gear mechanism provided in a toner container.
Figure 5:
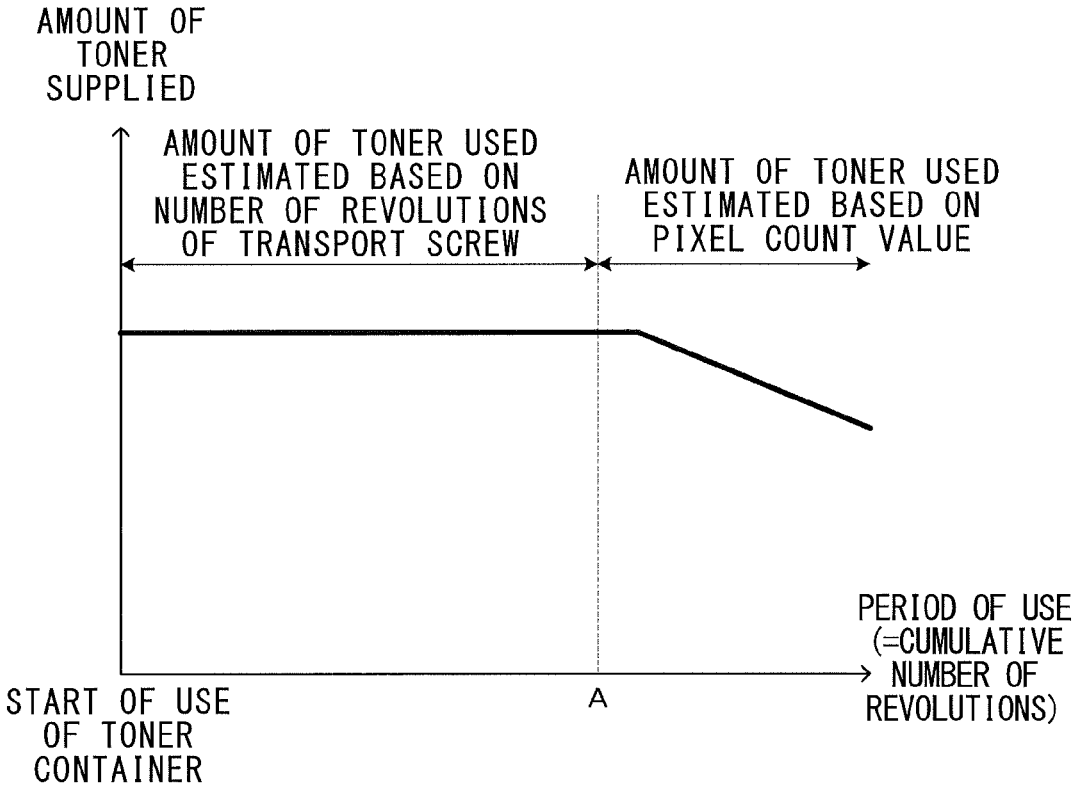
FIG. 5 is a plot showing how the amount of toner supplied changes after the start of use of a toner container.

Next, a description will be given of a toner container 17M, a toner container 17C, a toner container 17Y, and a toner container 17Bk. FIG. 2 is a perspective view showing the connection between a toner container and a developing unit. FIG. 3 is a plan view of a toner container with a cover removed. FIG. 4 is a rear view showing a gear mechanism provided in a toner container. FIG. 5 is a diagram showing a configuration of a principal portion of a gear mechanism, and of a drive motor, for driving the toner containers 17M, 17C, 17Y, and 17Bk.

At positions away from the developing units 122M, 122C, 122Y, and 122Bk, for example over them across the intermediary transfer belt 125, the toner container 17M for containing magenta toner, the toner container 17C for containing cyan toner, the toner container 17Y for containing yellow toner, and the toner container 17Bk for containing black toner are detachably attached to unillustrated toner container attachment portions provided in the apparatus body 11. When toner runs out, the toner containers 17M, 17C, 17Y, and 17Bk can be replaced individually as necessary, on which occasion a cover provided on the apparatus body 11 can be opened and closed.

The toner containers 17M, 17C, 17Y, and 17Bk each have a toner feed port 30 (FIG. 3) formed in their bottom face.

Whenever simply a toner container or a developing unit is mentioned, it refers to one of the toner containers 17M, 17C, 17Y, and 17Bk or one of the developing units 122M, 122C, 122Y, and 122Bk. The toner containers 17M, 17C, 17Y, and 17Bk are configured in a similar manner, and the developing units 122M, 122C, 122Y, and 122Bk are configured in a similar manner. In the following description, the toner containers 17M, 17C, 17Y, and 17Bk are collectively referred to as the toner container 17.

In a container body 27, over the toner feed port 30, there is rotatably provided a transport screw 320 as a transporting means. The transport screw 320 is composed of a rotary shaft 35, which is, at opposite ends in its length direction, pivoted on opposite side walls 33 and 34, i.e., a front side wall and a rear side wall, of the container body 27; a spiral fin 36, which is provided on the circumference of the rotary shaft 35 coaxially with it; and a transport gear 37 (see FIG. 4), which is provided at one end of the rotary shaft 35 in its length direction (in the embodiment, at the rear end).

In the container body 27, above the transport screw 320, on one side of it (in the embodiment, the left side), there is rotatably provided a first stirring paddle 38 as a first stirring means; above the transport screw 320, on the other side of it (in the embodiment, the right side), there is rotatably provided a second stirring paddle 40 as a second stirring means.

A container drive unit 26 is arranged in a rear part of the apparatus body 11, and is detachably attached to the toner container 17. The container drive unit 26 includes a toner motor 60 (FIG. 6), an output shaft of the toner motor 60, a pinion provided in an end part of the output shaft, and a drive gear meshed with the pinion.

The container drive unit 26 is also provided with a driven gear 18B, which rotates together with a rotary shaft pivoted on the container body 27. When the toner container 17 is attached to the apparatus body 11, the driven gear 18B meshes with the above-mentioned drive gear on the toner motor 60 side of the container drive unit 26. The driven gear 18B meshes with a gear 43 which rotates together with the rotary shaft of the first stirring paddle 38, a gear 48 which transmits a drive force to the rotary shaft of the second stirring paddle 40, and the transport gear 37 which rotates together with the rotary shaft of the transport screw 320, and transmits the rotating drive force of the toner motor 60 to the first stirring paddle 38, the second stirring paddle 40, and the transport screw 320.

The toner feed port 30 is connected to the interior of the corresponding developing unit via a pipe 310 disposed substantially upright in the apparatus body 11. As the transport screw 320 rotates, it transports toner to the toner feed port 30; thus, toner is supplied from the toner container through the pipe 310 to the corresponding developing unit. Accordingly, the amount of rotation of the transport screw 320 determines the amount of toner supplied from the toner container to the developing unit.

FIG. 5 is a plot showing change in the amount of toner supplied to the developing units 122M, 122C, 122Y, and 122Bk after the start of use of the toner containers 17M, 17C, 17Y, and 17Bk. After a toner container 17 is replaced with a new one and starts to be used, for a while, a sufficient amount of toner is present in the toner container 17, and thus the amount of toner transported by the transport screw 320 (the amount of toner supplied) remains approximately constant. However, as the amount of toner in the toner container 17 becomes smaller and smaller, the amount of toner transported by the transport screw 320 (the amount of toner supplied) gradually decreases. With this taken into consideration, in the image forming apparatus according to the embodiment, the amount of toner used is estimated, after the start of use of the toner container 17 until time point A when the cumulative value of the number of revolutions of the transport screw 320 reaches a previously determined value, based on the cumulative value of the number of revolutions of the transport screw 320, and after time point A, based on the number of pixels in toner images (pixel count value).

Figure 6:
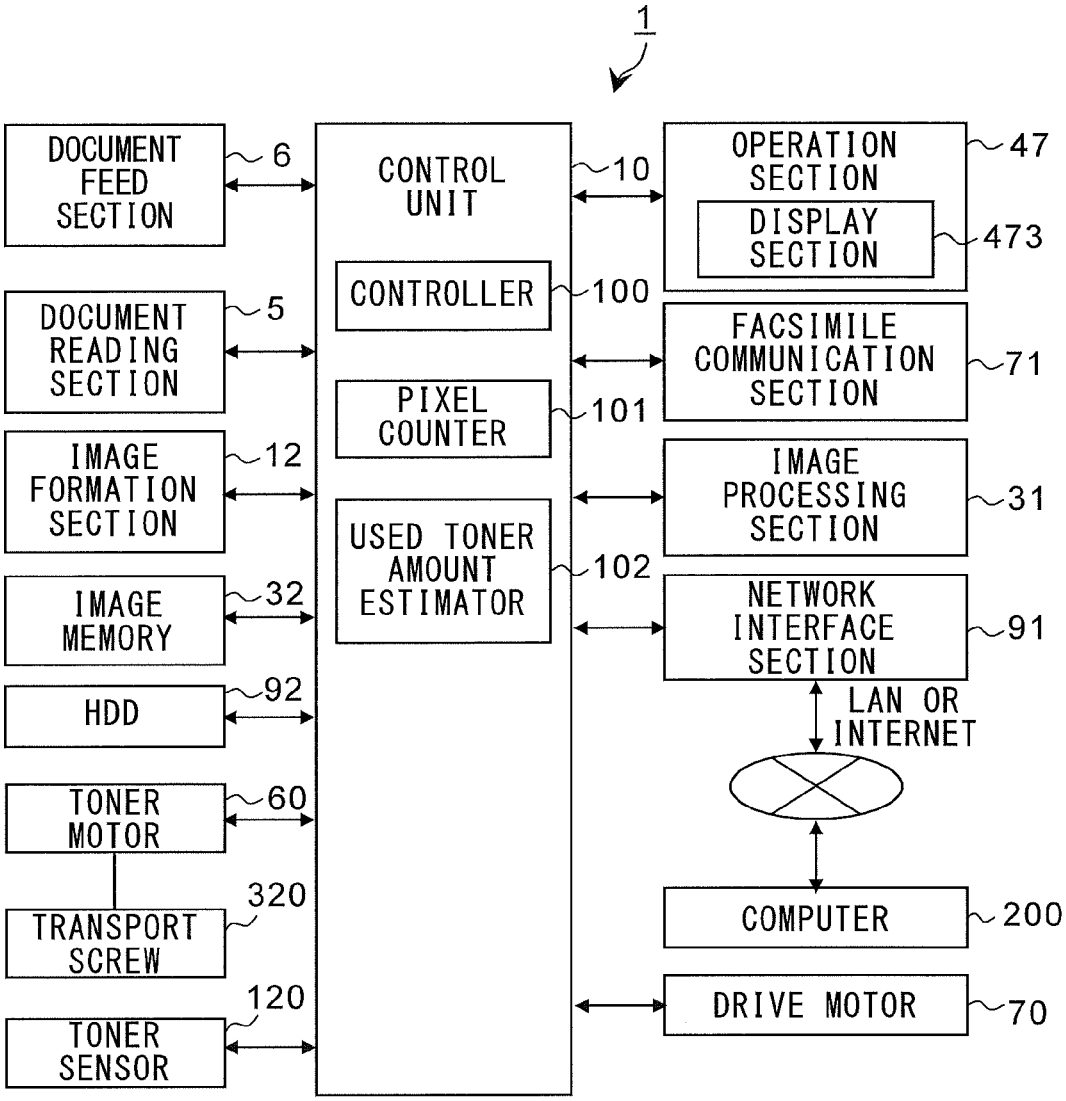
FIG. 6 is a functional block diagram showing a principal internal configuration of an image forming apparatus.

Next, the configuration of the image forming apparatus 1 will be described. FIG. 6 is a functional block diagram showing a principal internal configuration of the image forming apparatus 1.

The image forming apparatus 1 is provided with a control unit 10. The control unit 10 is composed of a CPU (central processing unit), RAM, ROM, dedicated hardware circuitry, etc., and governs the overall operation of the image forming apparatus 1.

The document reading section 5 is provided with a reading mechanism 163, which includes a light emitter, a CCD sensor, etc. Under the control of the control unit 10, the document reading section 5 irradiates a document with light from the light emitter, and receives the reflected light with the CCD sensor; it thus reads an image from the document.

An image processing section 31 performs image processing, as necessary, on the image data of the image read by the document reading section 5. For example, the image processing section 31 performs previously determined image processing such as shading correction to improve the quality of the image formed by the image formation section 12 based on the image read by the document reading section 5.

An image memory 32 is a region where the data of the document image obtained through reading by the document reading section 5 is temporarily stored and where data as the target of printing by the image formation section 12 is temporarily stored.

The image formation section 12 performs image formation based on print data read by the document reading section 5, or print data received from a computer 200 connected across a network, or other data.

The operation section 47 accepts, from the operator, instructions for various operations and processes that the image forming apparatus 1 can execute. The operation section 47 is provided with the display section 473.

When the image forming apparatus 1 is in normal operation mode, the display section 473 displays various screens such as an operation screen, a preview screen, a print job status monitor screen, etc. On the other hand, when the image forming apparatus 1 is in sleep mode, the display section 473 remains extinguished.

A facsimile communication section 71 is provided with an encoder/decoder, a modulator/demodulator, and an NCU (network control unit) (none of these is illustrated), and performs facsimile transmission across a public telephone network.

A network interface section 91 comprises a communication module such as a LAN board, and exchanges various kinds of data with a computer 200 or the like within a local area across a LAN or the like connected to the network interface section 91.

A HDD 92 is a large-capacity storage device which stores, among others, document images read by the document reading section 5.

A drive motor 70 is a driving force source which gives a rotation driving force to the relevant rotary members in the image formation section 12, a transport roller pair 19, etc.

The toner motor 60 is a driving force source which drives the transport screw 320 in each of the toner containers 17M, 17C, 17Y, and 17Bk to rotate. The rotation driving force of the toner motor 60 is transmitted to the transport screw 320 via an unillustrated gear mechanism.

A toner sensor 120 is provided in each of the developing units 122M, 122C, 122Y, and 122Bk to detect toner concentration there.

The control unit 10 is provided with a controller 100, a pixel counter 101, and a used toner amount estimator 102.

The controller 100 is connected to the document reading section 5, the document feed section 6, the image processing section 31, the image memory 32, the image formation section 12, the operation section 47, the toner motor 60, the drive motor 70, the facsimile communication section 71, the network interface section 91, the HDD (hard disk drive) 92, the toner sensor 120, etc. to drive and control these.

The pixel counter 101 acquires information on, among others, the image data as a target of image formation by the image formation section 12 from an image generation section (for example, the image processing section 31 functions as such an image generation section), and counts the number of pixels in the image data formed on the surface of the intermediary transfer belt 125 after the start of use of each of the toner containers 17M, 17C, 17Y, and 17Bk. That is, the pixel counter 101 counts the number of pixels in each of the toner images of different colors.

The used toner amount estimator 102 cumulates (counts) the number of revolutions of the transport screw 320 in each of the toner containers 17M, 17C, 17Y, and 17Bk; until the cumulative value (the total number of revolutions of the transport screw 320 as indicated by the count) reaches a previously determined value (for example, until time point A in FIG. 5), the used toner amount estimator 102 estimates the amount of toner used based on the cumulative value of the number of revolutions of the transport screw 320. That is, the used toner amount estimator 102 detects the amount of toner used based on the estimation. The amount of toner supplied per unit number of revolutions of the transport screw 320 in the period until the cumulative value of the number of revolutions of the transport screw 320 reaches the previously determined value can be previously acquired through experiments or the like, and thus the amount of toner used can easily be calculated from the cumulative value of the number of revolutions of the transport screw 320. The number of revolutions of the transport screw 320 can be detected, in a case where the toner motor 60 is a stepping motor, by counting the number of pulses as a drive signal.

After the cumulative value of the number of revolutions of the transport screw 320 in each of the toner containers 17M, 17C, 17Y, and 17Bk has reached the above-mentioned previously determined value, the used toner amount estimator 102 estimates the amount of toner used by multiplying the pixel count value of toner images by a coefficient. The coefficient indicates the amount of toner used per pixel, and is represented by, for example, $\alpha$ (mg/dot). The used toner amount estimator 102 can acquire the pixel count value of toner images from the pixel counter 101.

Furthermore, the used toner amount estimator 102 corrects the efficient $\alpha$ based on the pixel count value by the pixel counter 101 at the time point when the cumulative value of the number of revolutions of the transport screw 320 reaches the previously determined value (for example, at time point A in FIG. 5). What a represents is a coefficient (mg/dot) for calculating the amount of toner used for a previously determined number of pixels. Specifically, let X represent a standard number of pixels printed corresponding to the amount of toner used as observed when the cumulative value of the number of revolutions of the transport screw 320 reaches the above-mentioned previously determined value, and let Y represent the pixel count value by the pixel counter 101 as observed when the cumulative value of the number of revolutions of the transport screw 320 reaches the above-mentioned previously determined value (that is, the total number of pixels that have been actually printed after the start of use of the toner container); then the used toner amount estimator 102 corrects the coefficient a by multiplying it by X/Y. This is expressed, for example, by the equation (Used Toner Amount)=(Pixel Count Value)$\times\alpha\times$X/Y. The standard number of pixels printed X is a value previously determined for and given each device or model.

The coefficient a is thus corrected in the following manner. When X>Y (that is, when more toner is consumed than is supposed to be consumed for the actual amount of image formation), the coefficient a is corrected so as to increase. As a result, after time point A in FIG. 5, the amount of toner used is so estimated that an amount of toner somewhat larger than the standard amount is consumed. By contrast, when X<Y (that is, when less toner is consumed than is supposed to be consumed for the actual amount of image formation), the coefficient a is corrected so as to decrease. As a result, after time point A in FIG. 5, the amount of toner used is so estimated that an amount of toner somewhat smaller than the standard amount is consumed. In this way, the tendency of toner consumption which depends on the environment of use of the image forming apparatus 1 can be reflected in the estimation of the amount of toner used based on the number of pixels in toner images. It is thus possible to improve the accuracy of the estimation.

Figure 7:
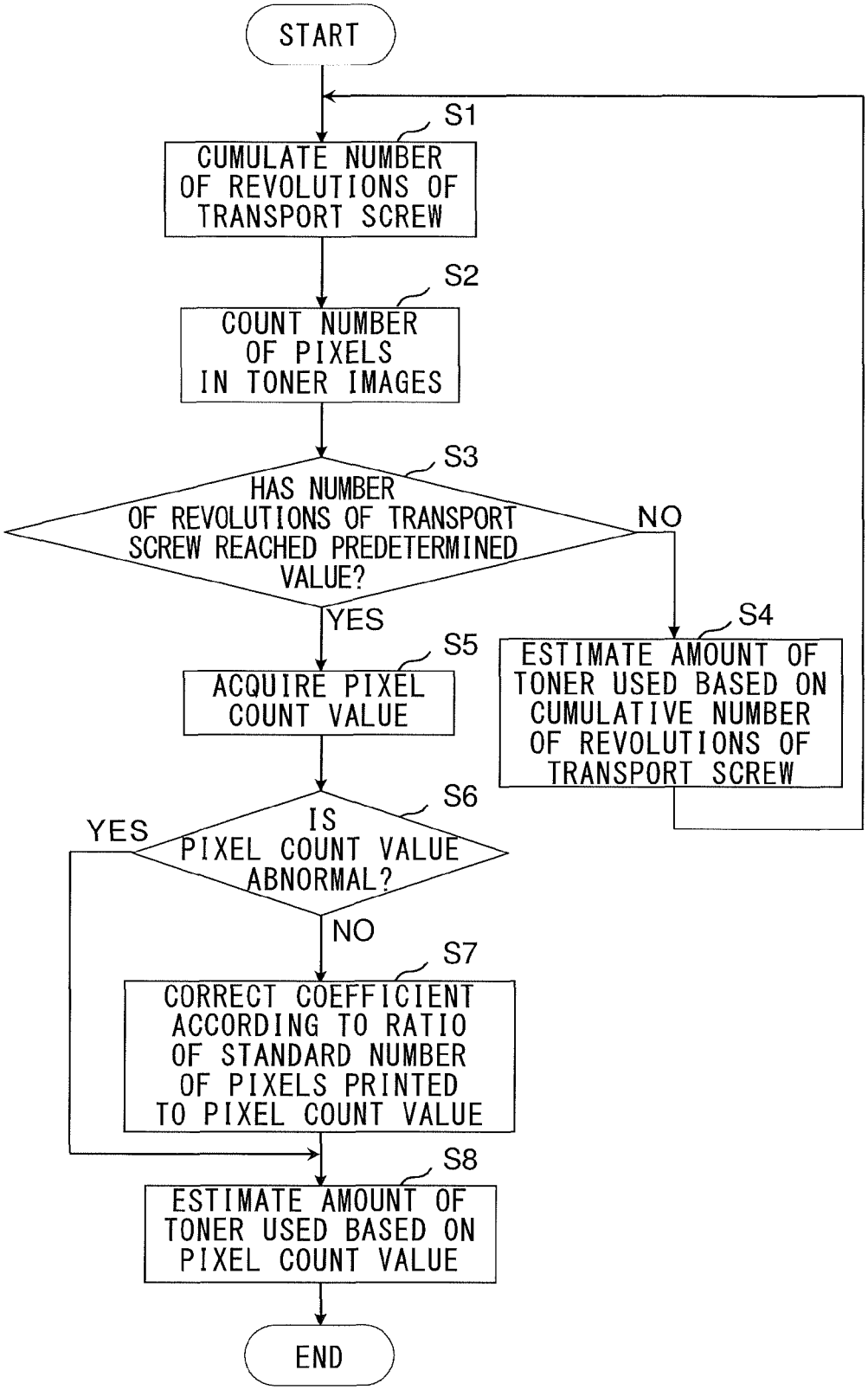
FIG. 7 is a flow chart of a used toner amount estimation operation in an image forming apparatus according to an embodiment of the present disclosure.

Next, a description will be given of how the amount of toner used is estimated in the image forming apparatus 1. FIG. 7 is a flow chart of used toner amount estimation in the image forming apparatus 1.

Starting with the start of use of the toner containers 17M, 17C, 17Y, and 17Bk, the used toner amount estimator 102 cumulates the number of revolutions of the transport screw 320 in each of those toner containers (S1). On the other hand, starting with the start of use of the toner containers 17M, 17C, 17Y, and 17Bk, the pixel counter 101 counts the number of pixels in toner images of each color (S2).

The used toner amount estimator 102 checks whether or not the cumulative value of the number of revolutions of the transport screw 320 in each of the toner containers 17M, 17C, 17Y, and 17Bk for different colors has reached a previously determined value (S3), and if it has not yet reached the previously determined value (S3, "NO"), the used toner amount estimator 102 estimates the amount of toner used for each color based on the cumulative value of the number of revolutions of the transport screw 320 in the corresponding toner container (S4). Then, the steps thus far are repeated from step S1.

On the other hand, if the cumulative value of the number of revolutions of the transport screw 320 is found to have reached the previously determined value (S3, "YES"), the used toner amount estimator 102 acquires a pixel count value from the pixel counter 101 (S5). The pixel count value acquired here corresponds to the pixel count value Y mentioned above.

Then, the used toner amount estimator 102 checks whether or not the pixel count value Y is an abnormal value (S6). For example, when the pixel count value Y is extremely large or small relative to the above-mentioned standard number X of pixels printed, that is, when the value of X/Y falls outside a previously determined range, the used toner amount estimator 102 takes the pixel count value Y as abnormal (S6, "YES"), and does not correct the coefficient α. On the other hand, when the value of X/Y falls within the previously determined range, the used toner amount estimator 102 takes the pixel count value Y as normal (S6, "NO"), and corrects the coefficient α. Specifically, the used toner amount estimator 102 corrects the coefficient a by multiplying it by X/Y.

Then, the used toner amount estimator 102 estimates the amount of toner used of each color by multiplying the pixel count value of toner images of that color by the coefficient α (or the corrected coefficient α if it was corrected at step S7). Thereafter, the detection of the amount of toner used of each color is performed through estimation of the amount of toner used of each color by the used toner amount estimator 102 by use of the coefficient α or the corrected coefficient α.

In conventional technology, calculation of the amount of toner used based on the number of pixels in toner images is performed by multiplying the number of pixels in toner images by a predetermined coefficient. The coefficient is previously determined to suit the characteristics of each device or model. However, a single device or model can be used in varying environments, and accordingly the amount of toner used to develop toner images can vary greatly with the use environment. Thus, inconveniently, with conventional technology, the accuracy of estimation of the amount of toner used based on the number of pixels in toner images is not high enough.

By contrast, according to this embodiment, it is possible to accurately estimate the amount of toner used out of the toner contained in each of the toner containers 17M, 17C, 17Y, and 17Bk. Thus, it is possible to accurately estimate the amount of toner remaining in each of the toner containers 17M, 17C, 17Y, and 17Bk.

The embodiment described above is in no way meant to limit the present disclosure, which thus allows for many modifications and variations. For example, although the embodiment described above deals with a color multifunction peripheral as an example of an image forming apparatus embodying the present disclosure, this is simply illustrative; the present disclosure finds applications in monochrome multifunction peripherals and other electronic appliances, for example other kinds of image forming apparatuses such as printers, copiers, and facsimile machines.

The structures and processes described above by way of an embodiment with reference to FIGS. 1 to 7 represent merely one embodiment of the present disclosure, and no limitation whatsoever to those specific structures and processes is intended.

What is claimed is:

1. An image forming apparatus comprising:

an image carrier on a surface of which an electrostatic latent image is formed;

a developing unit which feeds toner to the electrostatic latent image to form a toner image on the surface of the image carrier;

a toner container which has a transport screw and which drives the transport screw to rotate to transport toner contained in the toner container to supply the toner to the developing unit;

a pixel counter which counts a number of pixels in toner images that have been formed on the surface of the image carrier since a start of use of the toner container; and a used toner amount estimator which estimates an amount of toner used, until a cumulative value of a number of revolutions of the transport screw reaches a predetermined number, based on the cumulative value of the number of revolutions of the transport screw and, after the cumulative value of the number of revolutions of the transport screw has reached the predetermined number, by multiplying a pixel count value of the pixel counter by a coefficient, wherein the used toner amount estimator corrects the coefficient based on the pixel count value of the pixel counter as observed when the cumulative value of the number of revolutions of the transport screw reaches the predetermined number.

2. The image forming apparatus according to claim 1, wherein the used toner amount estimator calculates a standard number of pixels printed based on the amount of toner used as observed when the cumulative value of the number of revolutions of the transport screw reaches the predetermined number, and corrects the coefficient by multiplying the coefficient by a ratio of the standard number of pixels printed to the pixel count value of the pixel counter as observed when the cumulative value of the number of revolutions of the transport screw reaches the predetermined number.

3. The image forming apparatus according to claim 2, wherein the used toner amount estimator does not correct the coefficient when the ratio is out of a previously determined range.

* * * * *